Figure 8:
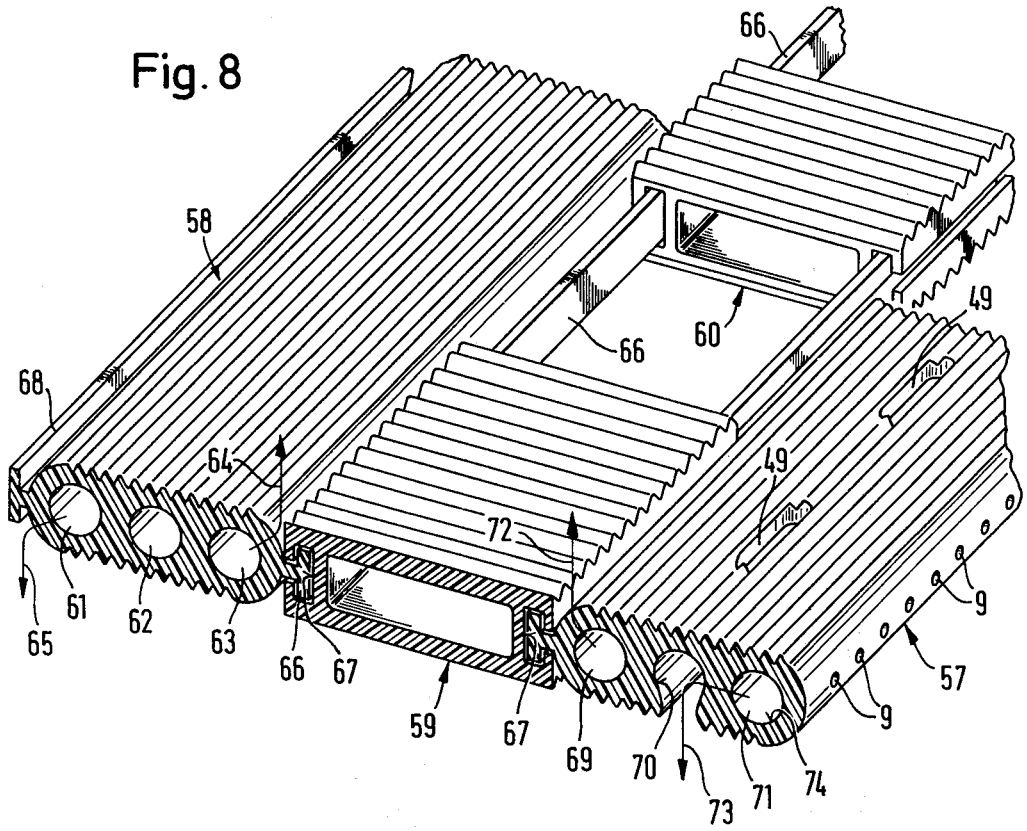

United States Patent [19]

Baumann

[11] 4,122,846

[45] Oct. 31, 1978

[54] BUBBLING DEVICE FOR THE TREATMENT OF THE HUMAN BODY

[76] Inventor: Ludwig G. Baumann, am Reckholder, CH Niederhelfenschwil, Switzerland

[21] Appl. No.: 775,602

[22] Filed: Mar. 8, 1977

[30] Foreign Application Priority Data

| | | | |
|---|---|---|---|
| Jun. 24, 1976 | [DE] | Fed. Rep. of Germany | 2628248 |
| Mar. 10, 1976 | [DE] | Fed. Rep. of Germany | 2609786 |
| Mar. 12, 1976 | [DE] | Fed. Rep. of Germany | 2610342 |
| Jul. 27, 1976 | [DE] | Fed. Rep. of Germany | 2633625 |

[51] Int. Cl.[2] ..... A61H 9/00

[52] U.S. Cl. ..... 128/66; 4/180

[58] Field of Search ..... 128/65, 66; 4/180

[56] References Cited

U.S. PATENT DOCUMENTS

| | | | |
|---|---|---|---|
| 3,076,976 | 2/1963 | Bogar | 4/180 |
| 3,240,208 | 3/1966 | Everston | 128/66 |
| 3,579,659 | 5/1971 | Baumann | 4/180 |

FOREIGN PATENT DOCUMENTS

| | | | |
|---|---|---|---|
| 1,133,077 | 7/1962 | Fed. Rep. of Germany | 128/66 |

*Primary Examiner*—Lawrence W. Trapp
*Attorney, Agent, or Firm*—Saul Jecies

[57] ABSTRACT

A bubble device for the treatment of the human body has two major surfaces, each adapted to support the body of a person to be treated. One of the surfaces is provided with relatively small bores for emergence of the bubble medium to obtain small pearly bubbles; the other surface is provided with relatively large bores to permit vigorous bubble streams to emerge. The bores of the different sides are fed via different supply lines and control valves.

9 Claims; 28 Drawing Figures

Fig. 1
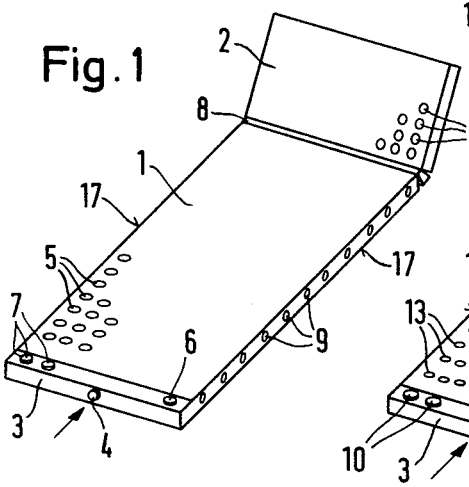
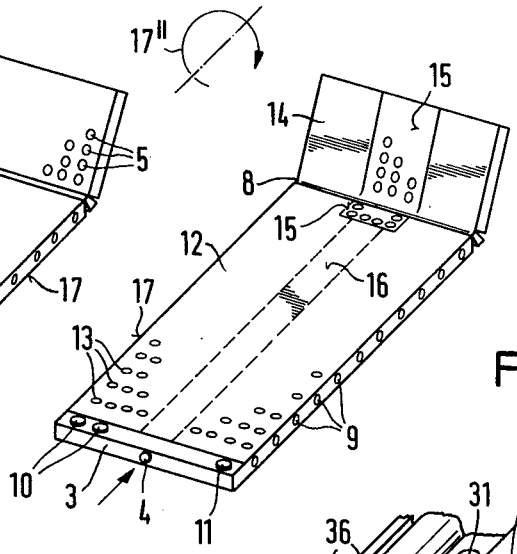
Fig. 2
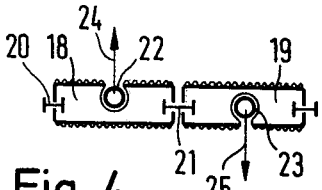
Fig. 4
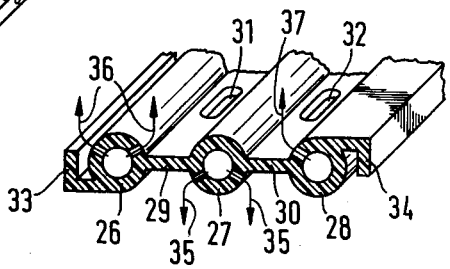
Fig. 5
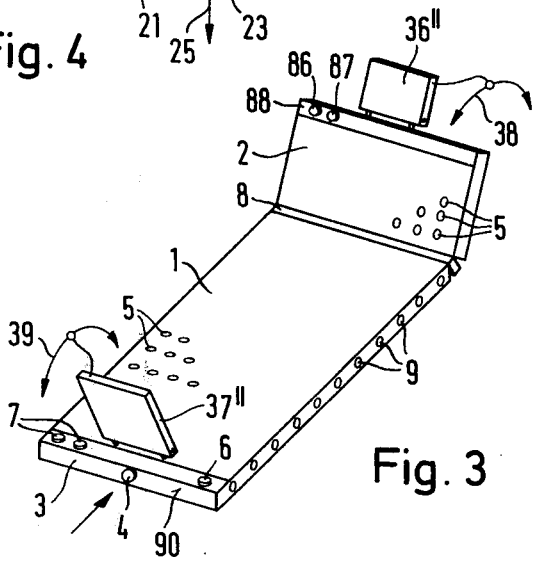
Fig. 3
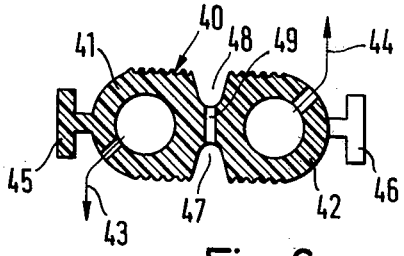
Fig. 6
Fig. 7
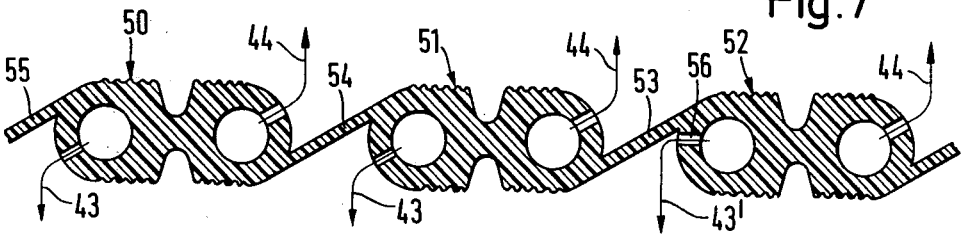

Fig. 10
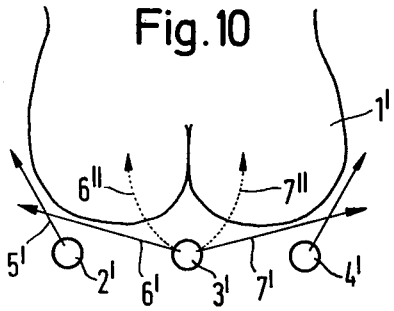
Fig. 11
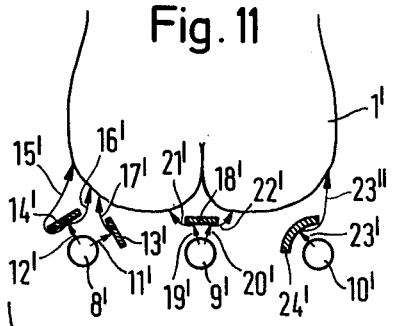
Fig. 12
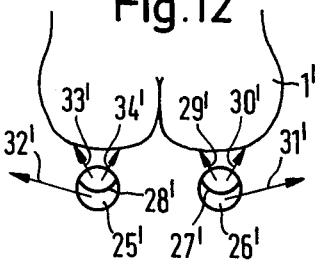
Fig. 13
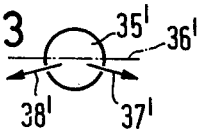
Fig. 15
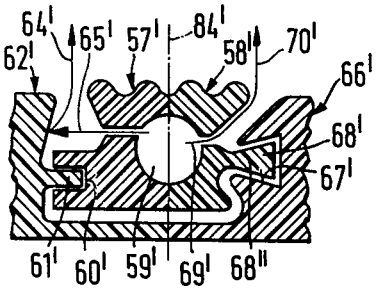
Fig. 16
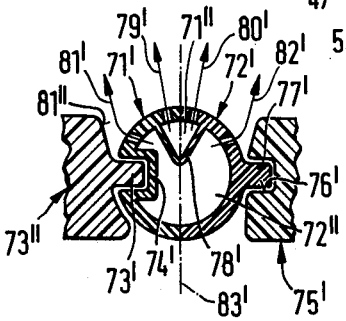
Fig. 14
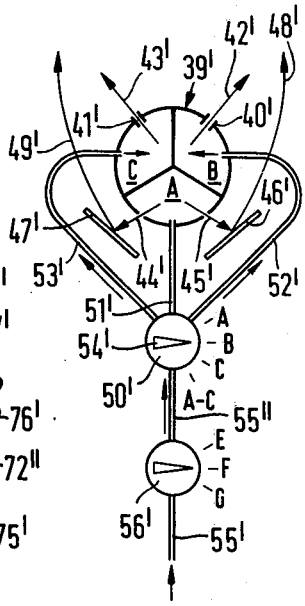
Fig. 17
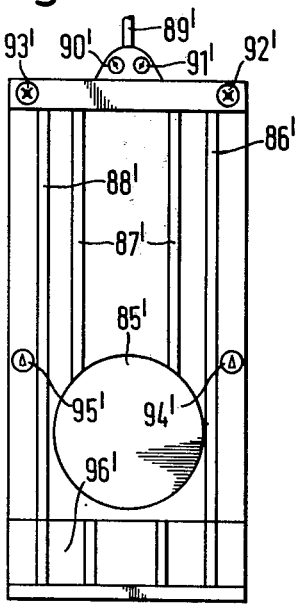
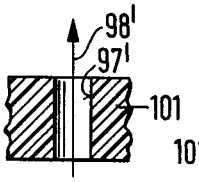
Fig. 18
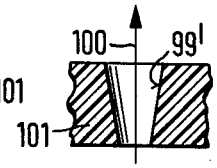
Fig. 19
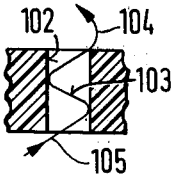
Fig. 20
Fig. 21
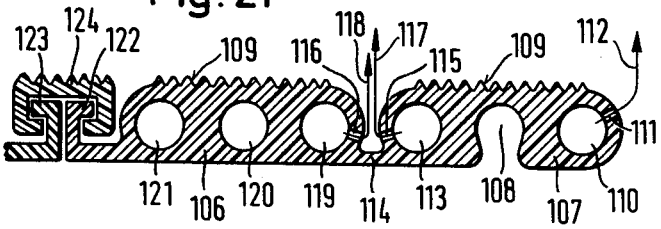

BUBBLING DEVICE FOR THE TREATMENT OF THE HUMAN BODY

The invention refers to a bubbling device in the shape of a bubbling mat for the treatment of the human body such devices are used for instance for air bubbling baths or likewise for foam baths, for example for domestic use in bathtubs.

The bubbling devices known so far were constructed in such a manner that the outlet holes were placed on one side of the mat or of the bubbling device while the outlet holes for foam baths are placed at the border of the bubbling device.

It has proved to be a disadvantage that the devices known so far are rather difficult to handle and had to be rather heavy.

The invention avoids the disadvantages of the bubbling devices known so far in such a way that it provides for a bubbling device of rather light weight and of low height which can be used for various bubbling modes. Furthermore, the bubbling device ought to be easy to handle and ought to adapt itself comfortably to the shape of the bathtub, i.e. the bubbling device has to be formed in a rather flexible manner.

In addition, the bubbling device of the invention has to be produceable in a simple manner and for this purpose well known plastics material and well known plastics manufacturing processes, such as plastics estrusion, must be used.

Besides, it must be possible to assemble the various parts of the bubbling device of the invention without any difficulty to produce various sizes of bubbling devices for use with different sizes of bathtubs.

This problem is solved by the invention in that a bubbling device which carries bubbling outlet openings on several sides and of such a kind that one of the bearing surfaces for the body carries rather small outlet holes or apertures for the bubble medium and that the other surface carries rather large outlet holes or apertures subject to the condition that it is possible to provide each apertured area with bubble medium each through separate supply lines and control valves.

This means that on one bearing surface it is possible to use the mat for a pearl bubble bath whereas one can take a heavy stream bubble bath by turning the mat to the other side.

Each side is provided with separate distributor and regulation devices which can be reached easily in the respective position of the mat.

Furthermore, the invention proposes that at least one part of the border connecting the bearing surfaces of the device carries additional holes which lead out sideways so that it is possible to take a rather dry foam bath when only a small quantity of foam medium is used. The respective regulation devices are placed at the bottom in a distributor device.

The device of the invention may be used for air bubble baths as well as for water bubble baths and, as already mentioned, likewise for foam baths.

Only very small changes are necessary for carrying out such various uses; it is sufficient, for example, to turn the mat over and it can then be used immediately for the other mode of bubble bath.

In a practical example the device of the invention can be formed as a flexible mat where the whole mat is composed of flexible parts of plastics material or where the mat is composed of an undivided flexible unit of plastics material. To this end it is possible to use extruded parts of plastics material which can be manufactured in some kind of tubular shape with separating webs.

It is possible to provide the distributor pressure with regulating devices for the control of the quantity and of the pressure of the bubble medium for the various modes of bubbling. These devices may, for instance, be constructed as pressure reducing valves or as safety valves.

This is useful for avoiding an overload of the mat and for permitting a preregulation of the bubbling power for the comfort of the patient.

The device of the invention has the great advantage that it makes possible a universal treatment of patients in such a way that there can take place very fine bubbling with air or an intensive bubbling with air or water; besides it is possible, according to one's choice, to arrange even a foam bath.

The invention is represented schematically in the appended figures. They show:

FIG. 1. : a bubbling device in perspective view where the bearing sruface with the holes for intensive bubbling faces upwards and the back part is slightly bent;

FIG. 2. : the bubbling device according to FIG. 1 but turned through 180 degrees in direction of the arrow so that the bearing surface with the holes for pearly bubbling faces upwards.

Figure 9:
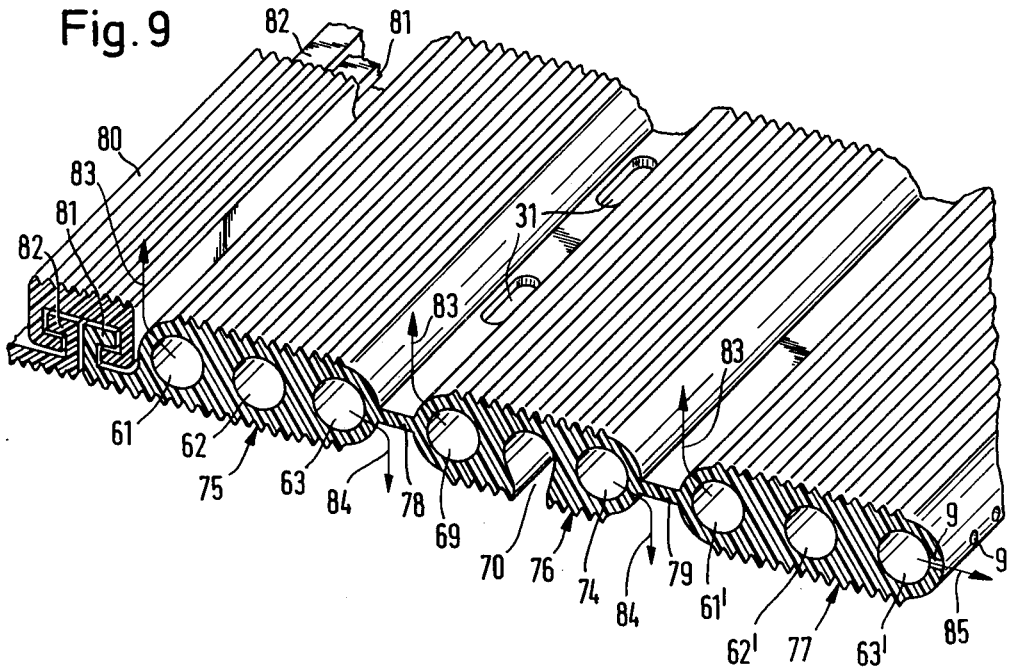

FIG. 3. : a device according to FIGS. 1 and 2 with for example a foot and a head part fastened on;

FIG. 4. : a practical example of the device in a construction in the shape of a caterpiller blade with 2 blades in sectional view with tightened, flexible tubes and lateral coupling pieces for the blades, FIG. 5. : part of a construction as a flexible mat with longitudinal plastic parts consisting of three tubular pieces with lateral coupling pieces, in perspective view, FIG. 6 : a practical example in the form of part of a flexible mat as an extruded tubular piece of plastic material wth two holes and middle openings with lateral coupling parts in sectional view, FIG. 7 : a group part of a flexible mat as an additional practical example in sectional view with special coupling parts, whereby the flexible mat may be constructed as an undivided unit, FIG. 8 : a device with mixed flexible and rigid mat parts in perspective view, FIG. 9 : part of a device in form of a flexible mat part in persepctive view with longitudinal flexible tube parts, with several holes and openings and lateral special fastening parts.

FIG. 10. : a partial view of a human seat with bubble tubes underneath for distribution of the bubble medium, the bubble streams being directed in such a way that they are on the other side of the human body;

FIG. 11. : a person's seat with bubble tubes underneath for distirbution of the bubble medium according to another feature, wherein the central axis of each of the bubble streams is directed in such a way that it passes the human body and furthermore baffle plates are located in front of each of the bores in order to deflect the bubble stream;

FIG. 12. : a further feature similar to the one according to FIGS. 10 and 11, with a combination of bubble streams, contacting the human body directly or crossing its bounds and those directed to the lines besides said bounds in such a way that both of the bubble streams can be switched on or off and combined together;

FIG. 13. : a view taken through a bubble tube with bores or outlet openings located below the horizontal plane;

FIG. 14. : a view taken through a bubble tube with a number of inlet chambers, a multiway valve and a flow control device;

FIG. 15. : a view taken through two kinds of bubble tubes, wherein left besides the central axis there is provided a tube with a holding groove in order to make a connection to a stationary device, and right besides said central axis there is provided another tube with a dovetailed part to be fixed with a stationary device, the latter design also being suitable for holding together two loose devices;

FIG. 16. : a section of two embodiments of bubble tubes wherein left of the central axis there is provided a tube with a groove and right of said axis an extension and wherein the tube has two chambers for the inlet of the bubble medium, the bubble openings being directed upright and also on the sides thereof;

FIG. 17. : a top plan view of a bubble mat;

FIG. 18. : an outlet bore for the bubble medium in an embodiment with a cylindrical bore;

FIG. 19. : a further outlet bore for the bubble medium in an embodiment with a conical bore;

FIG. 20. : an outlet bore for the bubble medium in a further embodiment with a bore having a wall in a spiral or a cyclone shape;

FIG. 21 : two embodiments for combined tube parts with a number of bores, on the left side with three closed bores, on the right side with bores open to the bottom and having a groove shape and at the left margin having a connecting device with a C-shaped neck and double-C-shaped connecting part, which can be sifted over said C-shaped neck for making a bigger mat from smaller parts and with a film hinge between the members of the smaller device.

Figure 22:
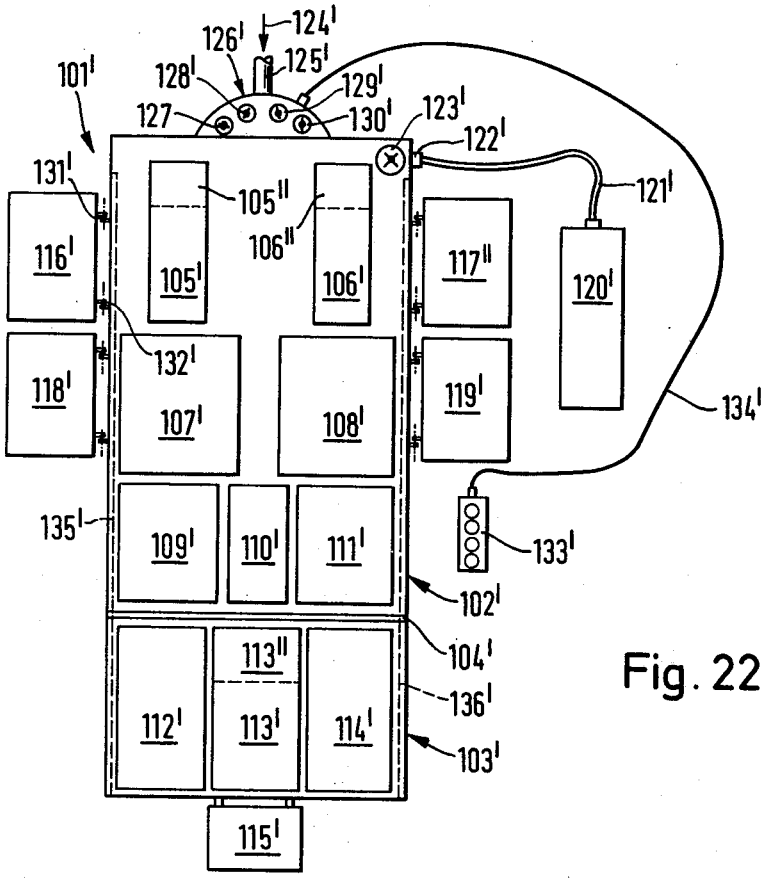
Figure 23:
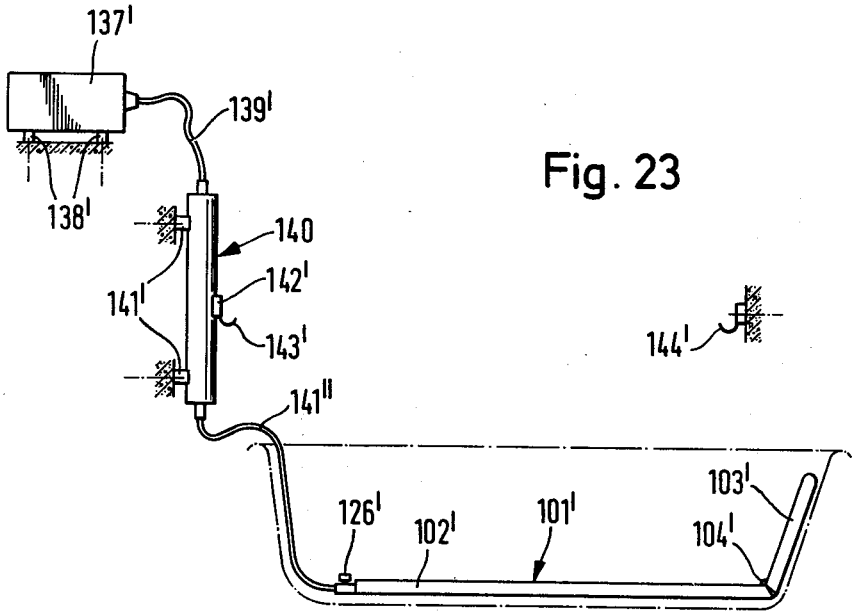
Figure 24:
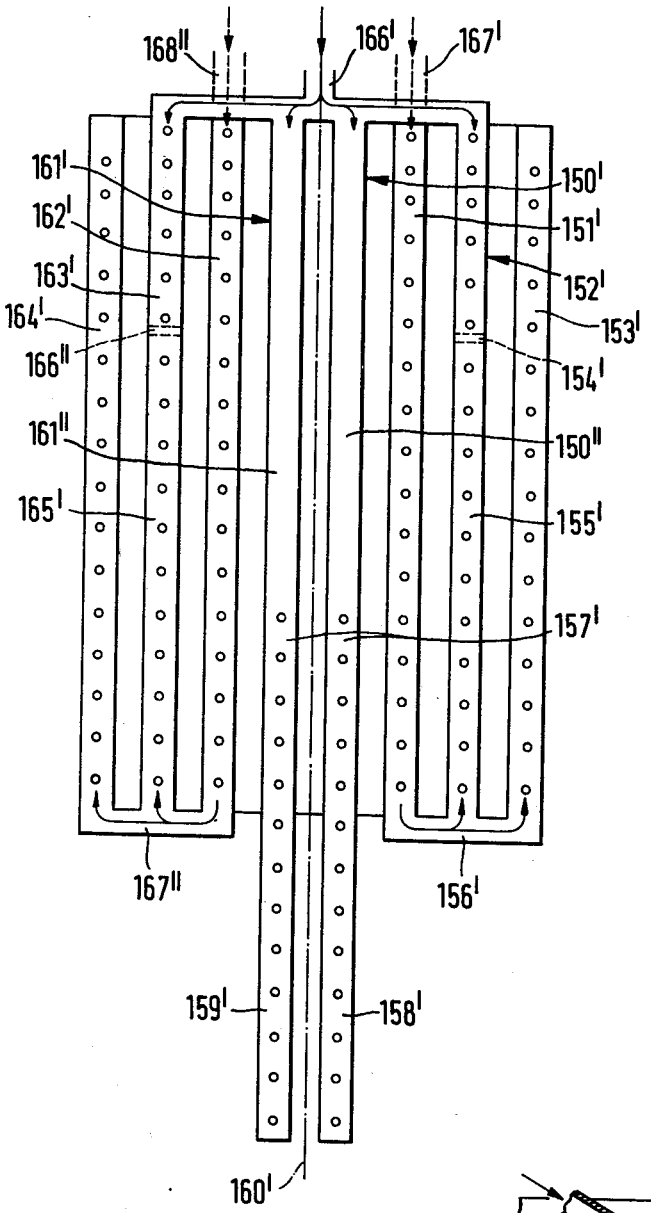
Figure 25:
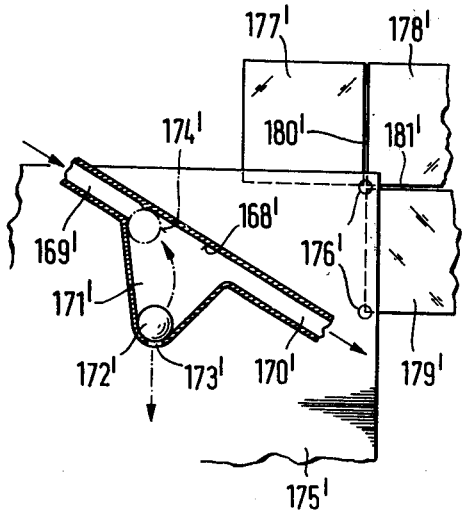
Figure 26:
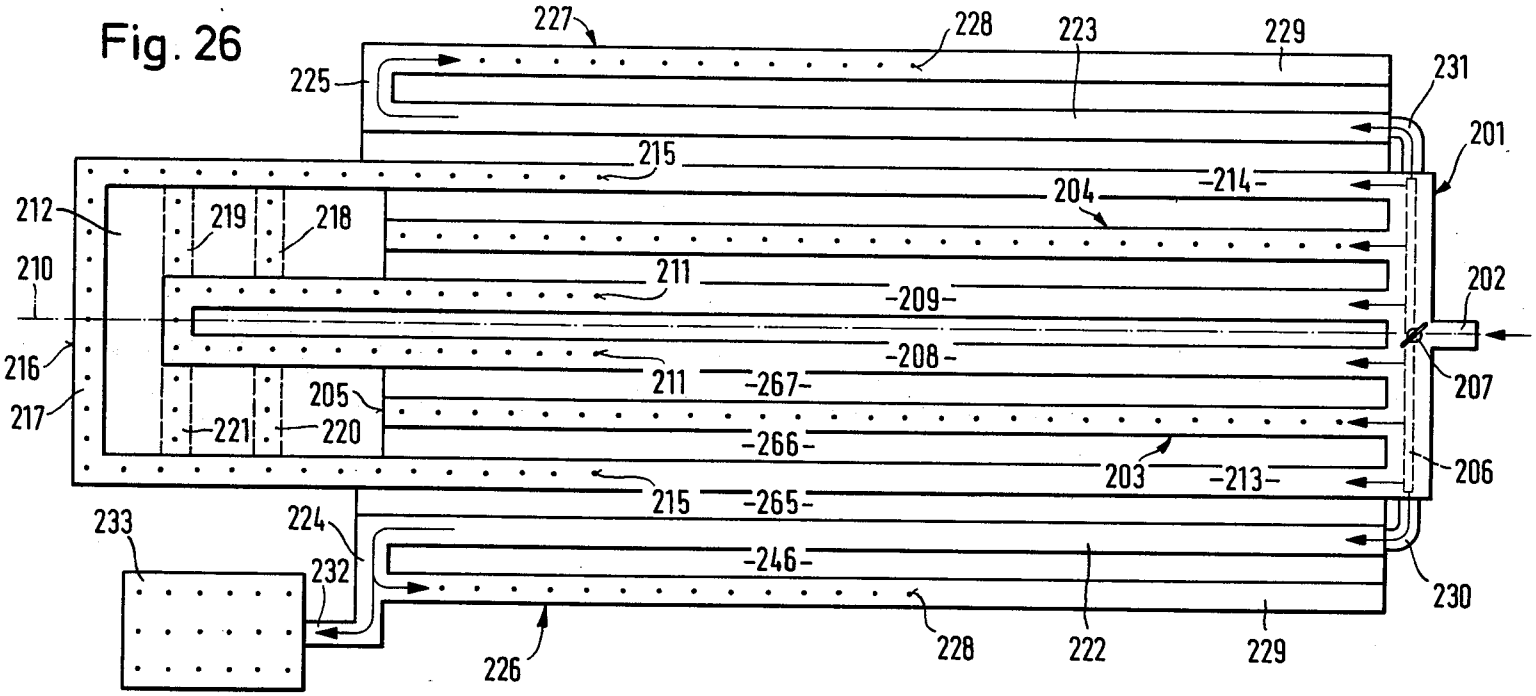
Figure 27:
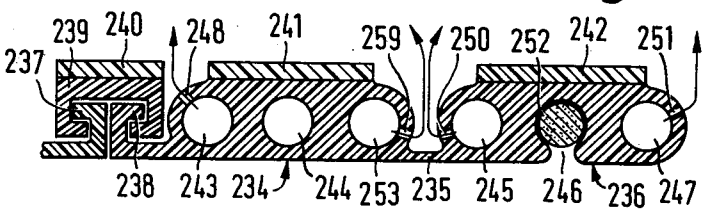

FIG. 22. : a top plan view of an embodiment of a mat, schemtically, with different zones with and without bubble bores with additional mat parts for different regions of the human body;

FIG. 23. : a bubbling device with a blower, a bathtub and a bubble mat and an interconnected water flow back preventing device;

FIG. 24. : is a top plan view, wherein zones with outlet bores and zones without such bores are locted one after the other;

FIG. 25. : shows an embodiment of a water back-flow preventing device in a sectional view;

FIG. 26. : a top plan view, schematically, of a mat made frm longitudinal, flexible plastic profile parts;

FIG. 27. : a fragmentary section through the mat according to FIG. 1; and

Figure 28:
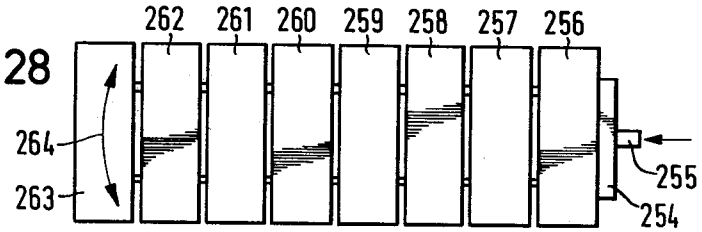

FIG. 28. : a top plan view of a mat made from plate shaped plastic parts.

The bubbling device according to FIG. 1 faces upwards with the resting surface which carries the holes 5 for intensive bubbling operations. The body of the patient rests upon this surface.

The patient is seated on part 1 and rests his legs, and a slightly bent back part 2 is elastically connected near 8 with part 1. In this case the holes 5 are made rather large so that it is possible to apply intensive bubbling operations. At the foot end there is placed a distributor 3 to which is supplied the bubbling medium through a fastening device near 4. The distributor has three regulating devices 7 for the various bubbling modes and for instance a regulating device 6 for handling the lateral openings 9 for a foam bath treatment. The holes 9 for foam bath treatment are likewise placed at the longer side 17.

In FIG. 2 the bubbling device according to FIG. 1 is turned through 180 degrees in direction of arrow 17' and it is shown that now the resting side having the holes 13 for pearly bubbling operations is turned to the body of the patient.

Part 12 is used for supporting it the buttocks and the legs whereas the head part 14 is turned slightly upwards. Part 12 has a surface 16 marked with dotted lines whereas no borings are provided, but the complete bubble energy is supplied to surface 15 and this permits intensive bubbling operations of the back part. In distributor 3 there are visible the regulating devices 10 for handling the resting side having the pearly holes and a regulating device 11 for obtaining a bubbling bath of special kind in which the holes 9 are put in action.

FIGS. 1 and 2 shown the simplicity of a bubbling device according to the invention whereby two resting sides are used for various bubbling operations and where it is possible, if need be, to provide even the border with holes for a bubbling bath.

A rather small thickness of the bubbling device is likewise of prime importance.

FIG. 4 shows in sectional view a one-part device which is composed of plate-shaped parts 18 and 19 above flexible coupling parts 21 and 20. There are clamped, in an opening in these plate-shaped parts, flexible tubes 22 and 23 which are provided with suitable holes so that bubble medium can come out in direction of arrow 24 and 25.

For example, on one side in direction of arrow 24 pearly bubbles will emerge through rather small holes whereas on the other side in direction of arrow 25 will emerge an intensive bubble stream through rather large openings.

The plate-shaped parts 18 and 19 are ribbed on the surfaces. The flexible tubes 22 and 23 are used in longitudinal direction as movable hinges for the plate-shape parts.

In FIG. 5 there is seen a flexible mat part which is composed of tube parts 26, 27 and 28 which are coupled by means of the webs 29 and 30. At the outside tube 26 there is mounted an additional coupling part 33 which makes a connection with the nearest longitudinal mat part. On the other side there is attached a coupling part 34 to the tube part 28. The flexible mat part is made of extruded soft plastics material. It is possible to provide openings 31 and 32 in the connection webs 29 and 30 so that the mat does not show any lift in the bathtub.

It is visible that bubble medium may come out upwards from tube part 26 in direction of arrow 36 just as this is also the case from tube part 28 in the direction of arrow 37. For example it is possible to have intensive bubble come out in the direction of said side.

Furthermore it can be arranged that on the opposite side, by means of appropriate holes, a pearly bubble stream may issue from the tube part 27 in the direction of arrow 35.

The practical examples according to the FIGS. 4, 5, 6, 7, 8 and 9 are suitable for equipping a bubbling device according to FIGS. 1, 2, 3 whereby, as seen from the practical examples, it is possible to obtain varied combinations.

FIG. 3 shows a device according to FIG. 1 to which is attached a head part 36", for instance, which is movable in the direction of arrow 38. Furthermore there is, for instance, attached at the footend a foot part 37'' which can be adjusted in the direction of arrow 39. The remaining reference numerals correspond to those of FIG. 1.

In the sense of the invention, the head part 36'' and the foot part 37'' can likewise be applied if the mat is used in the manner according to FIG. 2.

FIG. 6 shows part of a flexible mat 40 which is produced from flexible plastics material in an extrusion process. This is equipped with a tubular part 41 from which issue, e.g. on the one side pearly bubbles in the direction of arrow 43 and on the other side an intensive bubble stream which issues the direction of arrow 44. One side has a coupling medium 45 which may be used for attachment to other mat parts. The other side has a coupling medium 46. Furthermore, openings 47 and 48 may be provided which are suitable for reducing the weight as well as for diminishing the lift of the mat part in the bathtub. However it is likewise possible to arrange openings 49 in the remaining web between the gaps 47 and 48. It is advisable to provide grooves in the surfaces of the flexible mat part.

FIG. 7 shows a special practical example of a flexible mat which is composedof the parts according to FIG. 6 in such a way that there are arranged slanting coupling parts 53, 54 and 55 between the individual lines 50, 51, and 52 which run from one surface to the other. It is possible to produce in this way a rather flexible mat which is of very light weight and is of rather low thickness. The bubble outlet openings in the respective directions of the arrows correspond to the openings of FIG. 6.

It is apparent that the outlet openings can be even more inclined to the horizontal since the slanting coupling parts permits this in order to keep the bubble openings as far as possible away from the body of the patient and to obtain thus a bubble outlet which produces on the body a pleasant feeling.

This is especially indicated at part 52 by means of arrow 43'where hole 56 has been moved completely to the horizontal so that the bubble has to cover a rather long way to reach the body of the patient.

FIG. 8 illustrates another form of execution of the bubbling device where the device is composed of mixed mat parts, a flexible extruded mat part 57 and a flexible mat part 58 being coupled through a plate-shaped mat part 59 and 60 and at a corresponding distance. The mat parts 59 and 60 can be made of solid plastics. The mat parts 57 and 58 are longitudinally grooved whereas the mat parts 59 and 60 are horizontally grooved; this affords special traction for the patient.

The flexible mat part 58 contains borings 61, 62 and 63. In the event that the direction of the arrow 65 is downwards, the boring or pipeline 61 allows for instance pearly bubbles to issue. By way of example, the pipeline 62 may be used for supplying bubble medium to the surface 15 for an intensive bubbling of the vertebral column. In such a case it is attached at the distributor 3 to the appropriate regulating device.

On the other hand, boring or pipeline 63 is used for bubbling upwards in direction of the arrow 64, for instance, as an intensive bubbling stream. Furthermore one sees the coupling parts 66 and 68 by means of which the mat part 58 can be coupled laterally with other parts. By way of example, it is seen that the coupling part 66 in dove-tailed shape can be inserted into an opening 67 of the rigid mat part 59.

The mat part 57 is provided with a boring 69, an opening 70 and a boring 74. The boring 69 is used for supplying bubble medium which can come out upwards in the direction of the arrow 72 as an intensive bubble stream. The opening 70 is open on one side and pearly bubbles for example can come out of boring 74 in the direction of the arrow 73.

However, the mat part 57 may be placed at the border of the mat and borings may go outwards from the boring 71. Bubble medium in the form of air may be supplied through the pipe line 74, in order to make possible a foam bath. In this case the boring is closed in direction of the arrow 73. Thanks to the opening 70, the border of the mat is in this case particularly adaptable to the bathtub.

FIG. 9 concerns a flexible mat part shown in perspective view which consists of flexible pipe parts 75, 76 and 77 which are connected through flexible webs 78 and 79. Such a mat part consists of extruded elastic plastic material. It is possible to couple the mat part of FIG. 9 through coupling parts 81 and a sleeve web 80 with a neighbouring part and in doing so the coupling part 82 is used.

The mat part 75 contains pipe lines 61 for the supply of bubble agent to issue in direction of the arrow 83, by way of example for intensive bubbling, and a feed hose pipe 62 for the conveyance of bubble agent, for instance, for bubbling the back part. A feed hose pipe 63 is used for the conveyance of bubble agent for pearl bubbling in direction of the arrow 84 to the other side of the mat.

As far as part 76 is concerned, the conveyance of bubble agents and the outlet is carried on in the same way as explained above and the same reference numerals refer to the same elements. Bubble agent for the purpose of intensive bubbling treatment is supplied through the pipe line 69 while in the center there is provided an opening 70 in order that the mat shows little lift and is relatively movable. Bubble agent for the purpose of pearl bubbling treatment is supplied through the pipe line 74 in direction of the arrow 84.

The mat hose pipe 77 supplies, through the pipe line 61', bubble agent for intensive bubbling treatment while the pipe line 62' may be used for the supply of bubble agent for accessories. If part 77 is placed at the border of the mat, the pipe line 63' may, by way of example, be provided with borings 9 at the side and give off air or other bubble agents through borings in direction of the arrow 85 and it may thus be used for making a foam bath. The gaps 31 drawn in the figure are used, by way of example, for avoiding lift.

It is plain that the distributor for the various bubble agents must be provided with several spaces into which enter the regulating devices 6, 7, 10, 11 and that in this way the supply of the bubble agent to the various lines is made possible.

As a matter of course, the handles for the regulating devices may just as well be placed at the side, but it is more advisable to install them in basins on the surface in order that they can be reached only if the respective resting surface is exposed for use.

Furthermore the design of the device may be made in such a way that the various regulating levers block each other in order that one side only will be open to treatment.

The accessories such as the fittings used for head bubbling or feet bubbling, may be developed in such a manner that the fastening parts are constructed for example as feed pipes and that these pipes are installed at such places where they are provided for in the mat part.

By way of example it is possible to install according to FIG. 3, at the head-part a special distributing device 88 which is equipped with a regulating device 86 for the head-part 36 and with a regulating device 87 for the foot-part 37. The patient is thus in a position to himself easily regulate these accessories.

The devices known so far have the disadvantage that, particularly in the case of bubbling mats constructed in caterpillar shape, they must be relatively high construction since the flexible bubble channels are imbedded in rigid bubble grates and on account of its relative height the bubble grate is very much in the way in the bathtub particularly for corpulent persons since the water level is thus reduced.

As far as a special practical example is concerned, the head part and/or the foot part may likewise be joined firmly with the mat; for example, the bubble hose pipes or channels may be extended into the mat.

In FIG. 3, in a special practical example the distributor as well as the foot part are firmly integrated with the bubble grate or with the bubble mat. In that case the foot part is installed at the end piece 90 so that the foot part can be used with two mat surfaces.

In such a case the fastening device 4 is installed at another appropriate place.

At previous bubbling devices bores are provided for the outlet of the bubbling medium and they are directed upright or vertical so that the stream of the bubbles is able to hit the patient's body. In that way small holes and also bigger holes in the lines of a mat are used.

When the bubble stream hits the human body the patient feels chill, which feeling can be different depending on the patient's sensibility. This feeling will also happen in case the bubbling medium was warmed up before. There is a psychological feeling having no connection with the temperature of the bubble medium. It is based on the sensibility of the nerves located on the skin.

To date it could not yet be found out why this happpens, the more so than experiments have been made by further heating up the bubble medium to higher temperatures.

It is one object of the invention to overcome this feeling of chill as far as possible.

In the accompanied drawings there is shown according to FIG. 10 a human seat 1' and bubble tubes 2', 3' and 4' underneath can be part of a bubble mat as shown in FIG. 17. In the latter these tubes have reference numerals 86', 87', 88'.

It can been seen from FIG. 10 that bubble streams 5', 6' and 7' are directed in a straight line, when coming out from the bubble tube 2', 3', 4', so that they cannot contact, cross or touch the human body.

The bubble streams 5', 6' and 7' are identical with the central axis of the respective outlet bore of the bubble tube.

Bubble cores coming out from the outlet bores are not directed like the bubble streams but describe a line, which is about a base of natural logarithms in the direction to the human body to be treated. These lines are dotted lines and indicated with reference numerals 6'' and 7''.

From FIG. 11 a further embodiment can be seen wherein a human seat 1' above the bubble tubes 8', 9', 10' is partially shown.

The bubble tube 8' is provided with bores, which hold bubble streams 11' and 12' along a central axis of the bore. The bubble stream 12' leaves the tube 8' and touches a deflecting plate 14' whereby the bubble stream 12' is deflected and divided into bubble streams 15' and 16', which in turn are directed towards the human seat 1'.

The bubble stream 11' touches the deflecting plate 13' having another angle with the outlet opening and becomes the bubble stream 17' directed toward the human seat 1'.

Upwardly directed bubble streams, e.g. 19' and 20', leave the bubble tube 9' and touch a delfection plate 18 whereby bubble streams 21' and 22' are produced which are directed to the human seat 1'.

From the bubble tube 10' a bubble stream 23' emerges to the side and touches a delfection plate 24 which in one embodiment has a rounded surface and produces a deflected bubble stream 23'', which is directed towards the human seat 1'.

Deflection plates 12', 18' and 24' are shown schematically in FIG. 11. They can be in a form of necks or they can be shaped like a ledge or a strip longitudinally to the bubble mat.

The deflection plates can be designed, as regards their surface shape, in diverse manners and also the angle of the surface compared with the direction of the bubble stream can be varied depending on the stream power or depending on the stream deflection which is desired in order to obtain the respective effects with the human body to be treated.

In FIG. 12 for example underneath of the human seat 1' two bubble tubes 25' and 26' are provided, which are divided by dividing walls 27' and 28' so that on the upper side for example regarding the bubble tube 25' bubble streams 33' and 34' are directed immediately towards the human seat 1', whereas from the lower chamber a bubble stream 32' can leave the mat at the side. This means that from bubble tube 26' and from its upper chamber the bubble stream 29' and 30' touches the human seat and from the lower part the bubble stream 31'. In this way two or more different kinds of bubble streams can be directed to the human seat 1'. Both chambers can, of course, be controlled by different on-off devices, so that either just one of the chambers can be switched on or just the other chamber or else both of the chambers can be supplied with bubble medium.

In this way an individual and careful treatment can be selected according to the requirement.

It is, of course, also possible to lead just water at the requisite pressure through one of the chambers so that a message by water stream can be obtained and air may be pressed through the other of the chambers so that a treatment by air bubbles is possible. Furthermore both kinds of treating are possible and can be combined and bubble tubes can also provided which lead mixed water and air to those parts of the human body which should be treated.

In FIG. 13 a section of a tube 35' is shown schematically having a transverse radius 36'. Below the latter bubble streams 37' and 38' are shown, which leave respective bores. In this way bubble cores can be forced to move along a bow shaped path in order to reach the human body to be treated similar to FIG. 10 in which paths 6'' and 7'' are shown.

FIG. 14 shows schematically a section of a bubble tube 39' divided in three chambers A, B, C. The division can also, of course, be selected modified: in this embodiment it is shown just as an example. Additional divisions can be made in the diverse chambers and accordingly different kinds of treatment can be made including one using big bores and small bores.

From a supply device a bubble medium can be supplied by means of a tube 55' which, for example, can be controlled by means of a pressure control device 56' so that diverse pressures E, F, G can be selected. The bubble medium is led via the connection line 55" to the multiway device 50', which may for example be a multiway valve with a bell shape or having the shape of another control device or the like, and the medium can be led into chambers A, B, C by the valve control device 54', whereby each of the chambers can be used separately or in the lowest position all of the chambers A through C can be jointly supplied with bubble mediums.

By means of the tube 51' chamber A can be supplied, and by means of the tube 52' chamber B and by means of tube 53' chamber C can be supplied. It will be seen that from chamber A two bubble streams 44' and 45' will leave in a direction inclined directed to the bottom, which streams touch deflection plates 46' and 47' and are transferred as deflected streams 48' and 49' along a bow shaped path to the human body to be treated.

It will further be seen from FIG. 14 that from chamber B an inclined bore 4' having a relatively large diameter is provided having its opening above and hence, the bubble stream 42' leaving said bore is directed towards the human body to be treated.

From FIG. 14 it can further be seen that from chamber C and by means of a relatively small bore 41' a bubble stream 43' can emerge. In this way different bubble effects in connection with the human body to be treated can be selected and used.

In FIG. 15 two embodiments of bubble tubes can be seen in section, one of them being left of the middle axis 84 and the other being right of the middle axis 84'. Left of the middle axis 84' the tube 57' can be seen, which is designed as a tube having a profiled form and having a wave shaped surface. The tube 57' is provided on the left side with a groove 60' embracing a ledge 61" of the basic device 62". In this way it is possible to pull a bubble tube 57' into a basic device 62" longitudinally and to fix it therein.

A middle bore 59' can also be seen through which the bubble medium can be supplied. Also shown is the bubble stream 65', which is leaving at the side of bore 59' and which touches the wall of the basic device 62" which is used as a deflection surface, whereupon the deflected stream 64' is directed upwards.

On the right side of the central axis 84' a basic device 66 can be seen in FIG. 15, which device has a dovetailed groove 67' embracing counterpart 68' of the bubble tube 58'. In this way it is possible to use the bubble tube 58' to connect two basic devices 66' to one another. Part 68" can be used as a film hinge in case the bubble tube 58' is made from flexible material in order to have flexibility of the mat longitudinally and also transversely.

From the supply bore 59' a bubble stream 69' is emerging, which at the side wall of the bubble tube upwards is emerging a stream 70' and later reaches the human body to be treated.

In FIG. 16 two embodiments of bubble tube types are shown in section, wherein the one left of the middle axis 83' a bubble tube 71' having on the left side a U-shaped groove 74' embracing ledge shaped part 73' of the basic device 73". It is conceivable that such a tube can be drawn or inserted into a groove of a basic device, whereby the tube is fixed therein.

Right of the central axis 83' a bubble tube 72' is shown, which on the right side has a ledge 77', which in turn can be drawn or inserted into a U-shaped groove 76' of the basic device. In this way, also, a bubble tube, for example consisting of flexible plastic material can be drawn or inserted into a basic device and fixed therein.

It can further be seen from FIG. 16 that the inner space of the bubble tube can be divided by a dividing wall 78', which in this present case for example is V-shaped, so that from the upper chamber 71" bubble streams 79' and 80' can emerge directly to the human body to be treated. Also, it can be seen that from the lower chamber 72" lateral inclined bubble streams 81' and 82' can emerge, which reach the human body to be treated in a path formed like a bow. It is further possible to design the edge 81" of the basic device 73" as a deflection plate and further to shift it to the right side.

Under the condition of the example described the basis of FIG. 16 diverse kinds of treatment can be obtained and if required bores with smaller or bigger diameters can be provided.

In FIG. 17 a top plan view is shown of a bubble mat of which for example the seat region 85' is indicated schematically and the back part 96' is shown to be inclined upright. Of this mat the exemplary shown bubbling tubes 86', 87' and 88' can be seen. Further the supply tube 89' for the bubble medium can be seen wherein for example an inlet selector and control device with valve means 90' and 91' can be provided. In the same way control and selector devices 92' and 93' can be provided at the diverse branch devices or conjunction tubes for the bubble tubes. Further it is possible to provide control devices 94' and 95' in the seat region 85', which devices can simply be reached by hand, so that the patient himself can individually select the kind of the treatment and the power of the same.

In FIG. 18 a section through an outlet bore 97' can be seen for a bubble stream 98' having a cylindrical shape. The bore 97' is located in the wall of the bubble tube 101 and can be made by punching or drilling.

In FIG. 19 an outlet bore 99' can be seen which is usable for producing a bubble stream 100 of conical shape.

In FIG. 20 an outlet bore 102 can be seen which is spiral shaped in form of a spiral 103 or helix, so that the inlet stream 105 enters at an inclination compared with the wall of the bubble tube and the stream 104 will emerge inclined from the opening, i.e. in a spiral or helix shape, so that a specific kind of bubbling will happen which touches the skin very intensively.

The shape of the bore can also be designed in form of a cyclone opening by making the bore upwardly smaller, whereby the speed of the bubble can be raised and a more intensive treatment be obtained.

In FIG. 21 two embodiments for combined tube parts with diverse bores are shown. On the right side a certain part of the bubble tube is shown having two bores 113 and 110 for supplying the bubble medium, and in the middle a U-shaped groove 108 which is opened downwardly. In this way the mat is deposited on the bottom of the tub very stationary. On the upper surface the bubble tube parts are provided with ledges 109, which also can be defined as a fluting, so that the patient cannot slip on the mat.

It can be seen that on the left side a bubble tube part is located, which has the bores 119, 120 and 121 for the supply of the bubble medium. It is also possible to use only the bores 119 and 121 for the supply of the bubble medium, and the bore 120 is then open on both sides and hence can be used to keep the mat on the bottom of the bath tub.

It can be seen that both of the different bubble tube parts can be connected by a flexible zone 114, which is designed like a film hinge. The tube parts are made from flexible plastic material. Therefore the mat can adapt itself conveniently to the form of the tub.

It can further be seen on the left side that different mat parts can be connected by means of a C-shaped extension 122 and by means of a C-shaped extension 123 to the other mat part by means of a double-C-shaped ledge 124. Both of the parts also can be fixed together by an adhesive. Furthermore it can be seen from FIG. 21 how the bubble streams 112, 117 and 118 can emerge from bores 115 and 116 which are inclined downwardly. In this way the issuing bubble streams connot touch the human body to be treated directly along a straight line.

According to the invention the disadvantages of previous bubble bathing devices with distributing mats or bubble mats can be prevented by no longer directing the bubble streams to the human body and therefore a feeling of chill will no longer be developed. Furthermore according to the invention mats can be manufactured, which enable different kinds of bubbling.

It is disadvantageous in the previous bubble mats or bubble devices that bubble streams are emerging over the whole surface of the mat, so that also those parts of the mat are acting, which are not covered by the human body. Hence, at these locations energy of bubbling will be lost, which would be needed at other locations. This is avoided in some of the following embodiments. In FIG. 22 the mat consists of a main part 102' on which the patient is sitting and on which his legs are deposited, and further consisting of a back part or lean-back seat 103' in contact with the head oriented region of the bath-tub. This can also be seen from FIG. 23.

In FIG. 22 it can be seen how the surface of the mat can be divided into zones with emerging bubbles and those without emerging bubbles.

Between the lower part 102' and the lean-back seat 103' a film hinged device 4 is interconnected in order to move the two parts one against the other. From FIG. 22 zones 105' and 106' can be seen, for example, which are provided for the lower leg and for the feet. Further and adjacent to said zones additional zones 107' and 108' are provided which are for example usable for the upper thighs. Adjacent in the middle of the mat the zone 110' is shown, which can be used for the middle of the human seat. On the left side as well as on the right side zones 109' and 111' are provided, which should treat the human seat parts. In part 103' on the left side and on the right side zones 112' and 114' are shown, which should treat the human back and lumbar region. In the middle part the zone 113' is shown, which should treat the spine. Here, also for example as shown by the dotted line, a partial zone 113'' is possible, which only is provided for the treatment of the small of the back region. Adjacent to the part 103' and in the middle an additional part 115' is located, which for instance is provided for the treatment of the neck region. Adjacent to said part also side regions can be located or this part can be U-shaped, so that it can embrace the neck.

On the lower part 102' at the side adaptable additional mat parts 116' and 117' can be seen, which can be foldable to the inner side by means of hinges 131', 132' and can be set onto the upper side of the lower leg, so that they can be bubbled also from the upper side. Adjacent additional parts 118' and 119' can be located, which also are foldable by means of similar hinges and which are situated to bubble the upper surface of the upper thighs. The additional parts 116' through 119' also can be designed like a bow, so that they also can lead bubbles to the inner regions of the lower legs and the thighs.

Furthermore from FIG. 22 it can be seen that also for example additional parts 120' for treatment of the arms can be provided, which are supplied by means of a tube 121' from an intermediate part 122' and via a control device 123'.

In the same way as for the treatment of the arms for which, of course, two additional parts 120' can be provided so that both of the arms can be treated at the same time, also a further additional part like a helmet can be used for treatment of the head, and for example a design can be used like a motor cycle helmet. When using such a design for a head treatment the helmet can be provided with different emerging zones for bubbling, and also different kinds of bubble air, bubble water or a water-air-mixture can be used. The different zones 105' through 119' can also for instance be controlled by valves 127', 128', 129'and 130' combined or interconnected to a valve battery 126' which is located at the foot and of the mat and receives a stream 124' of liquid through a conduit 125', the control of the valve battery can be done at the patient's convenience.

Of course, it is also possible to provide a control device 133' near the hand of the patient, which device can be connected via a connecting line 134' with the valve battery 126', whereby the different valves can be handled as desired.

Further it is, of course, also possible to select by means of the control device 133' an oscillating treatment either by hand or by an automatic device, whereby for example in the valve device 126' oscillating valve parts can be used and hence an oscillating treatment is possible between the different zones with regard to the bubbling and/or its intensity.

This oscillating treatment is absolutely new and offers a substantial advance in treating the diverse kinds of sickness, which are susceptible to this kind of natural treatment. From FIG. 23 it can be seen how near or under the roof of the bath room a blower 137' is fixed by means of holding devices 138'. By means of a tube line 139' the blower is connected with the housing 140', which for example consists of a tube and which is mounted to the wall at the location indicated by reference numeral 141''. By means of a tube line 141' the housing 140' is connected with the bubble mat 101'. At the housing 140' a holding device 142' is provided by means of a hook 143' and on the other side at the end of the tub a further hook 144' is provided so that the mat 101' can be taken out of the tub and can be hung onto the hooks 143' and 144'. By doing this water drains out of the mat into the tub and by doing this quickly fluid also drain out of the tube line 141' into the housing 140', which fluid then after some time can drain out of the mat, so that a fluid compensation can happen.

The volume of the housing 140' is to be made so large that it is much bigger than the volume of the tube line 141' and a part of the volume of the mat 101', so that the housing 140' can take over the water when putting out quickly without draining via tube line 139' to the blower 137'.

At the upper part of the housing 140', a lip valve can be located. The latter would close when water flows in quickly and then open again when water is flowing away. Such a lip valve can easily be made from a light plastic plate.

Such a lip valve according to the invention brings a further raising of safety for bubble mats. As to the additional parts of the mat according to FIG. 31 one may for example provide particular parts 105" and 106" in a design like a cover, as shown in dotted lines, which can be put over the feet and make it possible to bubble them also.

From FIG. 22 it can also be seen that, for example at the side, channels 135' and 136' in form of bubble tubes can be fixed to or formed integral with the device, so that a foam bath is obtainable if for example only, so much fluid is filled into the bath tub that the mat is just covered.

These additional channels also can be controlled by a valve battery 26.

One embodiment provides for utilizing zones with outlet bores and those ones without bores in mats with bubble tubes, wherein of the tubes without bores one only used as tube lines and other parts as bubble tube lines.

This can also be obtained in that line tube parts are conected with bubble tube parts and they in turn are connected with line tube parts, which in turn are connected to bubble tube parts and so on. and, they can be designed in that way that in the bubble tube parts bores may be used with certain diameters, which generate either different pressures or the same pressures along the line, or/and which make it possible to generate different kinds of bubbling, for example pearl bubbling and/or jet bubbling.

From FIG. 24 it can be seen that on the right side of the central axis 160' there is provided a bubble tube 150', which in its lower part 150" has no bore, and starting from the seat region in the upper part 157' bores are provided so that from the seat region up to the back lean part 158' bores are provided. To the left of the central axis 160' the bubble tube 161' is provided, which its lower part 161" also does not have any bores, whereas starting from the seat region bores are provided reaching up to the back lean part 159'. Furthermore it can be seen that line tube parts 150' and 161' are supplied with air by a supply bore 166', which is controllable by means of a valve part or the like as indicated from the arrow. It can be seen by arrows that the bubble line or tube 152' also carries openings up to the closing part 154', whereby the lower legs or in a certain case also the thigh can be treated with bubbling. On the other side it will be seen that from the supply bores 166' in the direction of the arrow the bubble tube 163' can also be actuated for bubbling, whereby the bubbling tube or line 163' is closed at 166", so that just the lower legs or in a certain case also the thigh is treated by bubbling.

Furthermore it will be seen that via a supply opening 167' indicated by the dotted line the bubbling tube 151' can be supplied with bubbling energy, because it is provided with openings or bores, which extend over the whole length of the bubbling line or tube. At the upper end there is a transverse connection 156' leading to the tube part 155' and a further transverse connection to the tube part 153'. It will be seen that the tube part 155' extends to the closing device 154'. On the left side of the central axis 160' there is a supply opening 168" drawn in dotted line, which opening supplies the bubble tube 162' that has bubbling openings over its whole length and which also supplies air to the bubbling tubes 165' and 164' via a transverse connection 167".

From the embodiment according to FIG. 24 it can be seen that when using tubes or lines without bores or openings or chambers a bubbling is possible within only a region which actually needs the bubbling effect. Those parts of the lines or tubes not having bubble openings or bores are saving energy, which otherwise would stream out between the legs or besides of them.

Only one embodiment of the bubbling tubes is shown. However, other regions can also be provided with a bubbling effect in the same way, whereby for example also the thighs or only the back region is treated by bubbles.

The supply openings 166', 167' and 168', which are shown by way of example can, of course, also be supplied in known manner by a supplying battery or device having respective shut off or control valves, so that for example either the right side or the left side of the mat is supplied with bubble energy. Furthermore, of course, the valve battery can also be designed in such a way that only the inner or the outer line regions will be supplied with energy.

In a further embodiment the lip valve against water back flow can be so designed that preferably a rigid cover in form of an inclined line or tube part can be used having a housing part located in the middle, which housing part carries a bottom valve controllable by a skimmer or swimming ball adapted to close when raised and to prevent air flow from the blower.

The device can, of course, also be so designed that the tube line coming from the blower is located vertically and the housing part directed to the bottom, whereby at the middle part of the housing the line is directed to the lower section and to the mat.

In FIG. 25 a certain embodiment of the water back flow preventing device is shown schematically in section. The tube 169' can be seen which leads the air from the blower. At the tube a container part or cover part 171' is connected having a bore 173' which is normally closed by a skimmer or floating ball 172'. On the right side, inclined downwardly a tube part 170' follows, which leads to the bubble mat.

When connecting the tube 141' with the tube part 170' from FIG. 23 and when taking out the mat 101' of the tub, water will flow into the space 168' and the float ball 172' will be carried up, closing if necessary the tube 169' leading to the blower, when the float ball is in position 174' shown in a dotted line.

In this way a back flow preventing device can be provided which lets water pass through the bore 173' and which can protect the blower if the space 168' is dimensioned in the right manner.

From FIG. 25 it can be seen that the device shown therein is located on a base plate 175' and further that the mounting holes 176' are located at such distances that the mounting holes can meet the slots 180' and 181' between tiles 177', 178' and 179'. In this way an inclination of the tubes 169' and 170' can be reached when mounting the device.

The bubbling mat should be relatively light in weight and low or flat and particularly flexible. Furthermore the air bubble energy should be distributed equally to those parts of the human body actually to be bubbled. For example, losses at parts of the mat which are not covered by the human body, for instance between the legs or sidewise of the same, should be prevented. The following embodiments of FIGS. 26 to 28 are intended to achieve this.

In the drawings is shown:

Mainly the mat of FIG. 26 consistng of an air divider supplied with air by a blower via a line part 202. Following the air divider 201 diverse bores are provided partly as air channels and partly as parts of air bubbling channels. The latter are respectively switchable, to be switched on or switched from one position to anohter by means of a knob 207, which is part of a control device 206 shown schematically by dotted lines.

For instance air bubble channels 203 and 204 connected with the air divider 201 can be seen, which having bubble openings between the air divider 201 or air distributor and the end of the human seat 205, the bubble openings as well as their location being indicated by dots.

Right and left of the central axis 210 air channels 208 and 209 are located, which also are connected to air divider 201 and do not have any bores up to the human seat margin 211, whereas beginning from the human seat margin 211 until about up to the neck region 212 openings are provided so that an intensive bubble stream or a jet can emerge from said openings.

The supply of these air channels 208 and 209 can separately be controlled by means of the control device 206.

From the air divider 201 air channels 213 and 214 lead away which carry no air outlet bores until the margin of the human seat 215 whereas from there up to the neck region 212 and its end 216 openings are provided. The air channels 213 and 214 are connected by a transverse connection 217 at the upper end of the neck region 216, which transverse connection 217 is also provided with air outlet openings.

It is also possible that further transverse channels 218 through 211, shown by dotted lines, can be interconnected in order to bubble intensively the back and neck region. Also, of course, just two transverse channels 218 and 220 or 219 and 221 can be incorporated.

By means of flexible tube parts 230 and 231 further air channels 222 and 223 are connected to the rigid air divider 201, which air channels extend to the end of the human seat region 205 and which supply by means of intermediate parts 224 and 225 the outer air bubble channels 226 and 227 with air in the direction of arrows. In the air bubble channels 226 and 227 according to this embodiment holes are provided up to the region 228, which is located about, besides or under the thigh. The lower parts 229 do not carry any air outlet holes.

It can be seen how an additional mat device 223, for example used for bubbling the breast or the arms, can be supplied with air by means of an interconnection part 232. This operates by reason of enough air, which is in existence in channels 222 and 223. Such additional devices, however, can also be connected to the channel 223 at the other side.

Also it is, of course, possible to lead out air from the lower parts 229, for example for additional devices serving for the bubbling of the lower legs or the thighs.

In FIG. 27 a fragmentary section through the mat according to FIG. 26 is shown, and in this embodiment along the central axis flexible ledge parts 234 and 236 made of plastic are shown, which are connected to each another by means of a bridge 235, which can for example be a film hinge. A number of such flexible ledge parts made of plastic can be connected to each another by means of dovetails 237 and 238 embraced by C-shaped parts 239.

From FIG. 27 it can also be seen how the plastic profile portions are provided wth flexible sponge rubber or foam rubber parts 240, 241 and 242 which are secured by an adhesive or in another way.

From FIG. 27 further can be seen an embodiment of an air tube channel 244 going through the flexible plastic profile. Further a channel 246 for reduction of the lifting force can be seen, which for example can be provided with inserted ceramic parts 252 or the like.

Also, of course, a longitudinally closed channel as for example the air tube channel 244 can be used for weighting if it is filled with sand or with ceramic balls or the like.

In FIG. 27 air bubble channels 243 can be seen having an air bubble outlet 248, an air bubble channel 253 along with an air bubble outlet 249 and an air bubble channel 245 with just exemplary drawn air bubble outlet 250, further an air bubble channel 247 with an air bubble outlet 251. From this it can be seen that the flexible foam rubber cushion does not restrain the emerging air bubbles.

In FIG. 28 an embodiment of a mat according to the invention can be seen, consisting of plate shaped plastic parts 256 through 263. In this instance eight plates are connected together in a flexible way, so that they can be rolled up longitudinally. The embodiment, of course, is designed so that a flexibility exists also in the direction of the arrow 264, which flexibility can be obtained by the air bubble channels or air tube channels or by channels for reducing the lift force added to the device. A manifold 254 receives fluid via tube 255 to distribute it to the plastic parts.

In another embodiment also an air channel as supply channel can be used as a bubble channel, which for example is provided just with a few bubble openings and hence, the air coming from the distributor device cannot be pressed into the bath water so that the part of the air which is not needed will be transferred into another bubble channel.

The interconnection between the air tube channels and other channels can be established by means of tube portions in a form of a bow or by U-shaped tube portions and hence, the air will be relayed into bubble channels or into an air distributor located nearby, which in turn is located underneath the patient'3 seat or underneath the neck region so that a convenient operation of the bubble mat can be had.

For adding the cushion or bolster material to the mat portions said material can be bound with plastic foil or fixed by using an adhesive and laying foil sections around the mat portions. The bubble openings then will be bored through the plastic foil.

From FIG. 26 channels 246, 265, 266, 267 for reducing the lift forces can be seen, which are also symmetrically established on the other side of the central axis 210. According to FIG. 27 these channels can be designed as open channels 246 or instead as closed tube portions 244.

I claim:

1. Bubble device for treating the human body, comprising a support element having two alternatively usable body-supporting surfaces each of which faces away from the other;

a plurality of relatively small first outlet openings for the bubble medium formed in one of said support surfaces;

a plurality of relatively large second outlet openings for the bubble medium formed in the other of said support surfaces;

first means for supplying bubble-forming medium to said first outlet openings; and independent second means for supplying bubble-forming medium to said second outlet openings.

2. A device as defined in claim 1, said support element comprising a plurality of separate sections at least some of which are provided with respective ones of said first and second outlet openings, and hinge means connecting said sections to one another.

3. A device as defined in claim 1, said support element having a first section having one end portion and another end portion which constitutes a head support for a user, and a second section connected to said one end portion inclinable relative thereto and constituting a foot support for a user.

4. A device as defined in claim 3, said one section being composed of two parts connected with one another so that one of said parts is inclinable relative to the other part and constitutes said head support.

5. A device as defined in claim 1; and further comprising means for at least once deflecting each of the streams of bubbles which emerges from the respective outlet openings.

6. A device as defined in claim 1, wherein some portions of said support surfaces are free of the respective first and second outlet openings.

7. A device as defined in claim 1; and further comprising valve means for blocking the flow of bubble-forming medium to and through at least some of said first and second outlet openings.

8. A device as defined in claim 1, wherein said support element is at least in part of synthetic plastic material.

9. Bubble device for treating the human body, comprising an elongated support element having a central portion flanked by and hinged to a pair of elongated lateral portions, said support element having two alternatively usable body-supporting surfaces each of which faces away from the other;

a plurality of relatively small first outlet openings for the bubble medium formed in one of said support surfaces;

a plurality of relatively large second outlet openings for the bubble medium formed in the other of said support surfaces; and means for supplying bubble-forming medium to said first and second outlet openings selectively, said lateral portions being inclinable relative to said central portion so that said support element may be inserted into a container having a width smaller than the combined width of said center and lateral portions.

* * * * *